United States Patent [19]

Landwehr et al.

[11] 4,413,754

[45] Nov. 8, 1983

[54] DISPENSER OF SMALL QUANTITIES OF LIQUIDS

[75] Inventors: Frank Landwehr, Hochdorf; Heinz Wanner, Biberach, both of Fed. Rep. of Germany

[73] Assignee: Dr. Karl Thomae GmbH, Biberach an der Riss, Fed. Rep. of Germany

[21] Appl. No.: 354,206

[22] Filed: Mar. 3, 1982

[30] Foreign Application Priority Data

Mar. 13, 1981 [DE] Fed. Rep. of Germany ... 8107209[U]

[51] Int. Cl.[3] ..... B65D 37/00

[52] U.S. Cl. ..... 222/209; 222/541; 222/183; 222/323; 222/325

[58] Field of Search ..... 222/401, 633, 541, 420, 222/209, 183, 181, 323, 324, 325; 422/100, 104; 73/864.01, 864.02, 864.11; 604/162, 905, 214; 206/569, 571; 141/22, 24; 220/4 E, 4 B

[56] References Cited

U.S. PATENT DOCUMENTS

| | | | |
|---|---|---|---|
| 3,233,785 | 9/1962 | Burke | 222/420 |
| 3,568,673 | 3/1971 | Cowley | 604/162 |
| 3,574,306 | 4/1971 | Alden | 604/162 |
| 3,834,241 | 9/1974 | Garren et al. | 73/864.11 |
| 4,291,694 | 9/1981 | Chai | 604/162 |
| 4,296,071 | 10/1981 | Weiss et al. | 422/100 |

*Primary Examiner*—Joseph J. Rolla
*Assistant Examiner*—Patricia Kridler
*Attorney, Agent, or Firm*—Hammond & Littell, Weissenberger and Muserlian

[57] ABSTRACT

This invention relates to an apparatus for dispensing small quantities of fluid which comprises a hinged clamping member with a bellows attachment for receiving an elongated cylindrical tube containing fluid and having sealed ends, wherein the hinged clamping member consists of two half-shells which enclose an inner space; the two half-shells are enclosed by a retaining and supporting member; the retaining and supporting member consists of symmetrical halves which are connected to each other by a hinge; the inner diameter of the inner space corresponds to the outer diameter of the tube; the two halves of the retaining and supporting member have, adjacent to the hinge, recesses with stops and, on the side opposite the hinge, a locking or snap-fit member; the hinged half-shells comprise, at one end, a shaft whose outer diameter corresponds to the inner diameter of the cylindrical shaft of a bellows attachment; the bellows attachment is provided with an opening which permits the bellows attachment to be pushed unto the shaft; and the retaining and supporting device comprises, on its outer periphery, recesses which are adapted to fit the thumb and middle finger.

5 Claims, 7 Drawing Figures

DISPENSER OF SMALL QUANTITIES OF LIQUIDS

FIELD OF THE INVENTION

This invention relates to a liquid dispenser. More specifically, this invention relates to a dispenser of small quantities of liquids which comprises an elongated tube, a hinged clamping member, a retaining and supporting member, and a bellows means.

BACKGROUND OF THE INVENTION

Previously, micropipettes have been used for administering small quantities of medicinal liquid. When micropipettes are used, the medicinal liquid must be kept in larger storage containers from which the micropipettes can be filled. Medicinal fluids which are easily contaminated or which are very expensive to produce (e.g., interferon solutions) cannot be stored in this way; therefore, they cannot be administered by means such as micropipettes.

DETAILED DESCRIPTION OF THE INVENTION

Figure 1A:
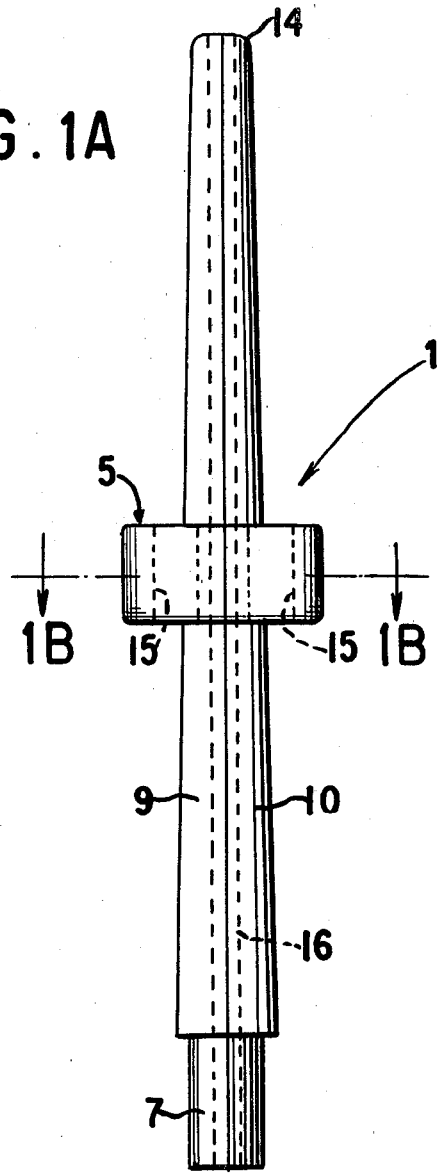
FIG. 1A represents an overall view of the hinged clamping member and the retaining and supporting member according to the invention.

According to applicants' invention, the problem of administering small quantities of fluids such as medicinal fluids that are impractical to store in large containers has been solved. The invention comprises an apparatus comprising an elongated cylindrical tube, for example, a capillary tube, which contains fluid such as medicinal fluid and which is sealed at each end; a hinged clamping member or device, consisting of two half-shells whose inner walls closely grip or embrace the elongated tube; a retaining and supporting member or device which encompasses a portion of the hinged clamping member; and a bellows means which is positioned upon one end of the hinged clamping member and covers one end of the elongated tube.

Just prior to use of the apparatus of the invention, the elongated tube is placed within the hinged clamping member, and then, the arrangement being in a vertical position, the elongated tube is opened at its upper end, the end nearest the "back" end of the hinged clamping member, and the hinged clamping member is folded shut. After the hinged clamping member has been folded shut, the bellows means is fitted so as to sit fully on a shaft provided at the back end of the clamping member. Then, the other lower end of the elongated tube, which is still sealed, is opened. Manual pressure on the bellows means will cause the contents of the elongated tube to emerge therefrom, for example, in the form of individual drops or a thin stream.

The hinged clamping member is provided with a retaining and supporting member by means of which the hinged clamping member can be opened, using two fingers, sufficiently to allow the elongated tube to be brought into the desired position without any difficulty. When the hinged clamping member is closed, the elongated tube is automatically centered between its two half-shells. To ensure that the half-shells enclose the tube all the time during use, a closure means, for example, a locking device, is provided, for example, within the retaining and supporting member mentioned above.

The hinged clamping member is so constructed that when the elongated tube which is to be received therein is mounted by pressing the two half shells of the hinged clamping member together, it is retained in a central position with the retaining and supporting member surrounding the two half-shells at a suitable point, preferably at about their longitudinal midpoint. The dimensions of the internal diameter of the hinged clamping member formed by the two half-shells, in the closed and locked position, correspond exactly to the outer contour of the elongated tube. This ensures that the elongated tube is fixed in the hinged clamping member and that overpressure produced by the compression of the bellows means to cause liquid to be forced out of the elongated tube, which has been opened at both ends, cannot be uselessly dissipated through leakage paths.

The retaining and supporting member fixedly connected to the two half-shells satisfies the logical spatial requirements for the insertion of the elongated tube, the application of the drops, and the necessary pause between two applications while avoiding any contact between the end of the tube and any other objects.

A concertina-type bellows means is preferably used as the bellows means for forcing drops out of the elongated tube. The bellows means attachment consists of a cylindrical shaft which merges into a concertina-type bellows with one or more folds. When the appropriate end, that is, the upper end, of the elongated tube has been removed, and after the half-shells of the hinged clamping member having been folded back over the elongated tube and locked in position, the bellows means attachment is pushed fully onto a shaft on the hinged clamping member provided for this purpose and adapted thereto. At its back end, the bellows means is provided with a sufficiently large opening to prevent any premature establishment of overpressure or underpressure when the bellows means attachment is pushed onto the shaft.

The two half-shells of the hinged clamping member are connected by means of a hinge. The hinge may be, for example, a thinner portion made of the same material as the half-shells (in the case of a plastic, this is the best solution, the hinge being produced by injection molding) or a film which holds the two half-shells together. This hinge may extend over the entire length of the half-shells or may be provided only in the region of the retaining and supporting member, which is positioned at about the midpoint of the length of the hinged clamping member.

Finger pressure on the retaining and supporting member spreads the two half-shells far enough apart for the elongated tube to be inserted without any difficulty. To ensure ease of manipulation, a recess is provided in the retaining and supporting member, adjacent to the hinge, and its dimensions are such that the recess also serves as an abutment or stop for opening the hinged clamping member.

After the elongated tube has been inserted, the two half-sheels are closed by shifting the finger pressure on the retaining and supporting member to the open edges of the half-shells, and these are then fixedly connected to each other by means of a locking or snap-fit device or some other suitable means.

When the apparatus of the invention is ready for use, first the end of the elongated tube pointing towards the shaft for the attachment of the bellows means is removed. This is done, for example, by breaking off the end of the elongated tube at a deliberately weakened point or by cutting it off with a knife or sawing it off with a saw. Then, the bellows means attachment is pushed over this open end of the elongated tube and fitted on the shaft provided for this purpose. Only then is the other end of the elongated tube removed in the same way. Capillary forces prevent the liquid from flowing out of the elongated tube until the liquid is actually administered, even if the apparatus for administration is held vertically.

For administration, the retaining and supporting member is held, at recesses provided for this purpose, between the thumb and the middle finger. The tip of the index finger is placed on the end face or surface of the bellows means, e.g., concertina-type bellows, thereby automatically covering or sealing the bellows means opening at the same time. A light even pressure downwards on the bellows means toward the retaining and supporting member causes the liquid to drip out of the tube.

The invention can perhaps be better understood by making reference to the drawings. As can be seen from FIG. 1A, hinged clamping member (1) consists essentially of two reciprocally identical half-shells (9) and (10), having inner space or recess (16). In another sense, hinged clamping member (1) also comprises a cannular-shaped body having at one end a tip (14) and, at the opposite end, a shaft (7), all of which are integrally formed by half-shells (9) and (10). The hinged clamping member (1) has a retaining and supporting member (5) positioned transversely upon it.

Figure 2:
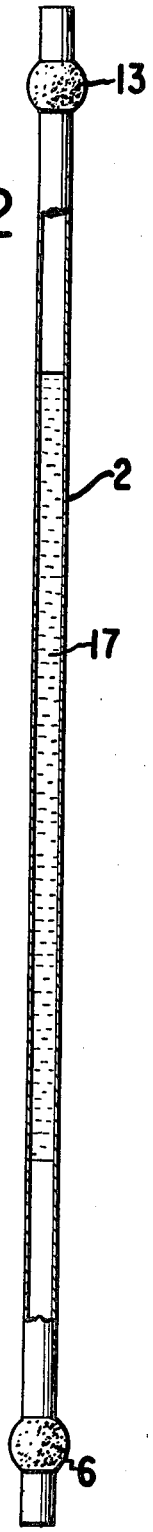
FIG. 2 represents a partial section through an elongated tube which has been sealed at both ends and contains medicinal fluid.

The elongated tube (2) represented in FIG. 2 is sealed, for example, heat-sealed, at its ends (6) and (13) after being filled with a medicinal liquid (17). Preferably ends (6) and (13) have each been provided with a deliberately weakened breaking point located in front of each end, that is, each breaking point is located substantially adjacent to an end between the end and the midpoint of the elongated tube (2).

Figure 3:
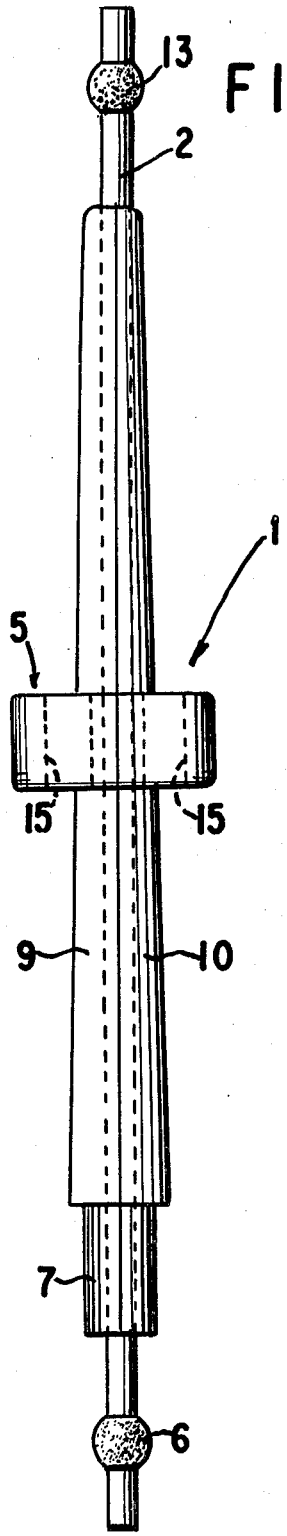
FIG. 3 represents an overall view of the hinged clamping member and the retaining and supporting member shown in FIG. 1A but with an elongated tube inserted.

As can be seen in FIG. 3, elongated tube (2) is positioned within hinged clamping means (1) in such a way that ends (6) and (13) protrude. The dimensions of the inner walls of hinged clamping means (1) and those of the outer diameter of the elongated tube (2) should correspond to the extent that the elongated tube (2) is tightly held by the hinged clamping means (1).

Figure 4:
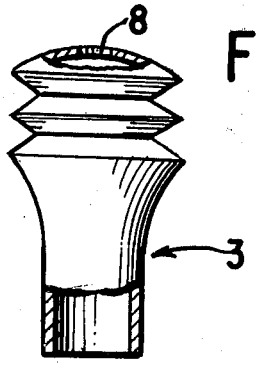
FIG. 4 represents a bellows means attachment, the lower part of which is cut away.

In FIG. 4, bellows means attachment (3) has an opening (8) at its top. Once the end (6) of the elongated tube (2) is broken, bellows means attachment (3) is to be slipped onto shaft (7) where it should be firmly fixed. More specifically, the open, lower portion of bellows means (3) should fit snugly onto shaft (7).

Figure 1B:
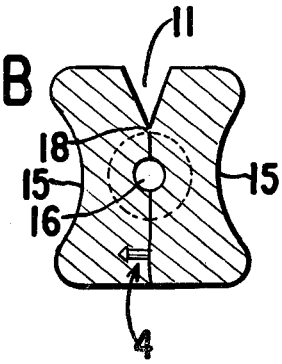
FIG. 1B represents a sectional view of the retaining and supporting member in FIG. 1A.
Figure 5A:
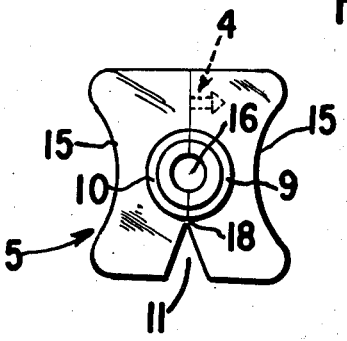
FIGS. 5A and 5B represent sectional views of the retaining and supporting member in closed and open positions, respectively.
Figure 5B:
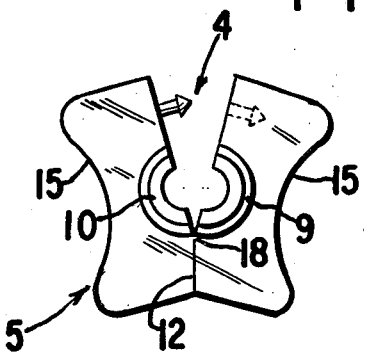

Retaining and supporting member (5) is set forth in more detail in FIGS. 1B, 5A, and 5B. Retaining and supporting member (5) consists of two symmetrical halves connected to each other by a hinge (18). A snap-fit means (4), preferably a locking means, is located opposite hinge (18). Adjacent to the hinge (18), retaining and supporting member (5) has a recess (11) in the two halves of the retaining and supporting member (5), which halves are rotatable about the hinge (18). The rotary motion of the halves for the opening operation is limited by stop (12). On its outer surface retaining and supporting means (5) has recesses (15) for engagement by the thumb and middle finger of a user.

As mentioned above, hinge (18) comprises a part of retaining and supporting member (5). The two half-shells (9) and (10) of hinged clamping member (1) are also connected by a hinge means, which is not depicted specifically in the drawings. Said hinge means for the hinged clamping means (1) may either be continuous along one longitudinal edge of the half-shells (9) and (10) or may be discontinuous or intermittent. The hinge means will be positioned so that it is adjacent or concurrent with hinge (18).

The particular materials from which the components of the apparatus are made are not critical, and many materials known to those skilled in the art may be employed. Preferably, the elongated tube comprises a rigid sterilizable material, for example, glass, metal, or a plastic, such as Teflon®, or even comprises a plastic-coated glass or metal. Advantageously the hinged clamping member, the retaining and supporting member, and the bellows means are each comprised of a plastic such as Plexiglass®, polyethylene, polypropylene, or polystyrene. The bellows means should, of course, be comprised of a substantially flexible material.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. An apparatus for dispensing small quantities of fluid which comprises a hinged clamping member with a bellows means attachment for receiving a primary packing means in the form of an elongated cylindrical tube containing fluid and having sealed ends, said bellows means attachment having a cylindrical shaft, wherein the hinged clamping member consists of two half-shells which enclose an inner space; the two half-shells are enclosed by a retaining and supporting member; the retaining and supporting member consists of symmetrical halves which are connected to each other by a hinge; the inner diameter of the inner space corresponds to the outer diameter of the tube; the two halves of the retaining and supporting member have, adjacent to the hinge, recesses with stops and, on the side opposite the hinge, a locking or snap-fit means; the hinged half-shells comprise, at one end, a shaft whose outer diameter corresponds to the inner diameter of said cylindrical shaft of said bellows means attachment; the bellows means attachment is provided with an opening which permits the bellows means attachment to be pushed onto the shaft; and the retaining and supporting device comprises, on its outer periphery, recesses which are adapted to fit the thumb and middle finger.

2. The apparatus of claim 1, wherein the two half-shells are connected by a hinge means that extends the length of the half-shells.

3. The apparatus of claim 1, wherein the two half-shells are connected by a hinge means that is intermittent along their length.

4. The apparatus of claim 1, wherein the elongated tube is provided with a deliberately weakened breaking point in front of each sealed end.

5. The apparatus of claim 1, wherein the bellows means attachment comprises a concertina-type bellows.

* * * * *